US010677530B2

(12) United States Patent
Jedraszak et al.

(10) Patent No.: US 10,677,530 B2
(45) Date of Patent: Jun. 9, 2020

(54) TUBE BODY AND PRODUCTION METHOD

(71) Applicant: Mahle International GmbH, Stuttgart (DE)

(72) Inventors: Pawel Jedraszak, Ostrow Wielkopolski (PL); Andrzej Krupa, Ostrow Wielkopolski (PL); Michal Maleszka, Ostrow Wielkopolski (PL); Lukasz Zywica, Tarchaly Wielkie (PL)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 16/064,374

(22) PCT Filed: Dec. 21, 2016

(86) PCT No.: PCT/EP2016/082145
§ 371 (c)(1),
(2) Date: Jun. 20, 2018

(87) PCT Pub. No.: WO2017/108929
PCT Pub. Date: Jun. 29, 2017

(65) Prior Publication Data

US 2018/0372412 A1 Dec. 27, 2018

(30) Foreign Application Priority Data

Dec. 21, 2015 (EP) ..... 15201615

(51) Int. Cl.
*F28D 1/03* (2006.01)
*F28F 3/02* (2006.01)
(Continued)

(52) U.S. Cl.
CPC ..... *F28D 1/0391* (2013.01); *F28F 3/025* (2013.01); *F28F 3/027* (2013.01); *F28F 3/046* (2013.01);
(Continued)

(58) Field of Classification Search
CPC . F28D 1/0391; F28F 3/025; F28F 1/40; F28F 3/046
See application file for complete search history.

(56) References Cited

U.S. PATENT DOCUMENTS 8,438,728 B2 * 5/2013 Zobel ..... B21C 37/151 165/177

FOREIGN PATENT DOCUMENTS

CN 107002871 A 8/2017
DE 3725602 A1 2/1989
(Continued)

OTHER PUBLICATIONS

FR-3036468-A1 machine translation (Year: 2016).*
(Continued)

*Primary Examiner* — Gordon A Jones
(74) *Attorney, Agent, or Firm* — Fishman Stewart PLLC

(57) ABSTRACT

A tube body for a heat exchanger may include an outer structure composed of a band material. The outer structure may include two mutually opposite wide sides and two mutually opposite narrow sides delimiting an outer structure interior space. The tube body may further include an inner structure integrally arranged on the outer structure and composed of the band material. The inner structure may be arranged in the outer structure interior space and divide the outer structure interior space into at least two fluid ducts fluidically separated from one another through which a fluid is flowable. The band material may have a material thickness and, at least in certain portions, a material thickness of a portion of the band material defining the inner structure may be less than a material thickness of a portion of the band material defining the outer structure.

16 Claims, 1 Drawing Sheet

(51) Int. Cl.

| | |
|---|---|
| ***F28F 3/04*** | (2006.01) |
| *F28D 21/00* | (2006.01) |
| *F28F 9/00* | (2006.01) |

(52) U.S. Cl.
CPC ..... *F28D 2021/008* (2013.01); *F28F 9/001* (2013.01)

(56) References Cited

FOREIGN PATENT DOCUMENTS

| | | | | | |
|---|---|---|---|---|---|
| DE | 102006052581 | A1 | | 5/2008 | |
| DE | 102008052785 | A1 | | 4/2010 | |
| DE | 102014200708 | A1 | | 7/2015 | |
| EP | 1489372 | A1 | * | 12/2004 | ..... F28D 1/0391 |
| EP | 3096102 | A1 | * | 11/2016 | ..... F28D 1/0391 |
| FR | 2869678 | A1 | | 11/2005 | |
| FR | 2923591 | A1 | | 5/2009 | |
| FR | 3036468 | A1 | * | 11/2016 | ..... F28D 1/0391 |
| JP | H10311694 | A | | 11/1998 | |
| JP | H11351777 | A | | 12/1999 | |
| WO | WO-2008011115 | A2 | * | 1/2008 | ..... B21C 7/151 |

OTHER PUBLICATIONS

EP-1489372-A1 machine translation (Year: 2004).*
English abstract for DE-102014200708.
English abstract for FR-2869678.
English abstract for JP-H10311694.
English abstract for JP-H11351777.
English abstract for DE-102008052785.
English abstract for FR-2923591.
English abstract for DE-3725602.
English abstract for DE-102006052581.
Chinese Office Action dated Aug. 1, 2019 in parallel Chinese Patent Application No. 201780013572.5.

* cited by examiner

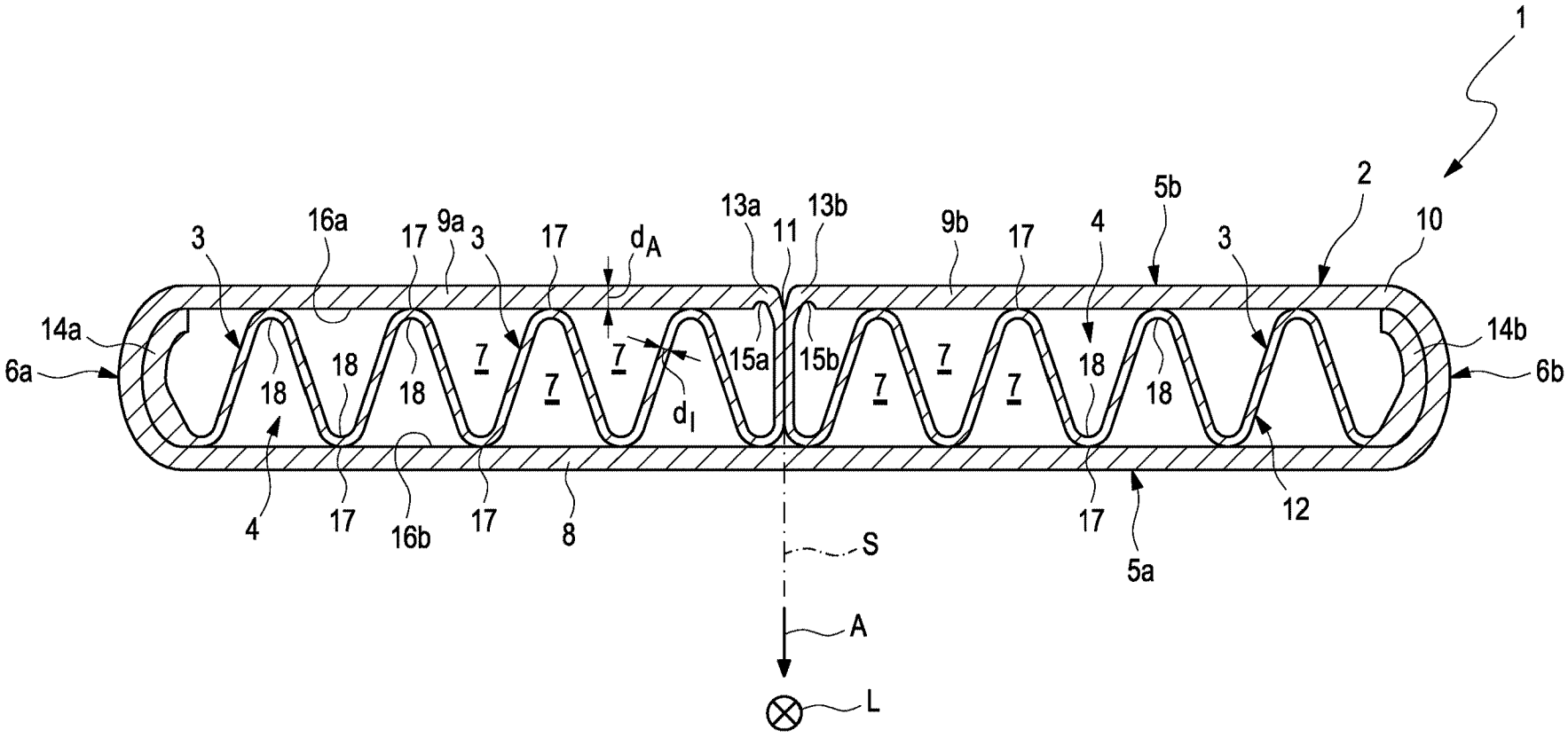
1
2
3
4
5a
5b
6a
6b
7
8
9a
9b
10
11
12
13a
13b
14a
14b
15a
15b
16a
16b
17
18
S
A
L
$d_A$
$d_I$

TUBE BODY AND PRODUCTION METHOD

CROSS-REFERENCE TO RELATED APPLICATIONS

This application claims priority to International Patent Application No. PCT/EP2016/082145, filed on Dec. 21, 2016 and European Patent Application No. EP 15201615.0, filed on Dec. 21, 2015, the contents of both of which are hereby incorporated by reference in their entirety.

TECHNICAL FIELD

The invention relates to a tube body and to a heat exchanger having at least one such tube body. The invention further relates to a method for producing the tube body.

BACKGROUND

Flat tubes through which a fluid can flow are routinely used in heat exchangers. While the fluid flows through, heat exchange can be produced between the fluid inside the flat tube and a second fluid, such as, for example, the surrounding air outside the flat tube. To increase stability and heat exchange, rib structures can be arranged inside the flat tube.

The prior art discloses a multiplicity of flat tubes which can be used in a variety of applications. Thus, there exist, for example, extruded flat tubes which have a one-part closed casing. In this context, extrusion processes require high pressures to produce sufficient deformation of the raw material. Furthermore, the investment costs for an extrusion system are very high and the extrusion tools are subject to a high degree of wear. Owing to the high pressures, the tolerance windows for the material thickness of the extruded flat tubes that is produced are relatively high, a factor which can lead to inaccuracies within the context of mass production and to increased reject rates. The tube designs which can be produced by extrusion are also limited.

It is therefore further known for flat tubes for heat exchangers to be fabricated from a sheet metal band in a continuous method on an appropriate tube production machine. After bending and shaping the flat tube cross section, the flat tube is closed by a welded or brazed longitudinal seam. Such flat tubes are used, for example, for coolant radiators in motor vehicles, the flat tubes being joined by corrugated ribs to form a block and brazed. In order to achieve as low a pressure drop as possible on the air side, the flat tube cross sections are formed to be as slender as possible, and, in order to increase the internal pressure resistance, webs, folds or beads are provided which act as tension rods and divide the flat tube cross section into chambers.

Against this background, DE 10 2008 052 785 A1 discloses a flat tube for heat exchangers having two narrow sides and two wide sides, which flat tube can be produced from at least three sheet metal strips having deformable longitudinal strips. Two of the sheet metal strips form an outer wall of the flat tube, and the third sheet metal strip forms a corrugated inner insert. The three sheet metal strips are brazed to one another.

FR 2 923 591 concerns a flat tube having two end portions folded inwardly towards the centre. Such folding makes it possible to form two fluid ducts which are fluidically separated from one another in the flat tube.

DE 10 2004 concerns a flat tube for a heat exchanger, which is produced from a one-piece sheet metal band and has inwardly directed impressions which act as turbulence generators for the fluid flowing through the flat tube.

DE 37 25 602 concerns a flat tube for a heat exchanger, which is composed of a bent metal strip and has a support web in its interior between the tube flat strips. The metal strip is braze-plated at least on one side. The support web has a bearing surface which is brazed onto the tube wall on the tube flat side.

DE 10 2006 052 581 A1 concerns a flat heat exchanger tube which is produced from a single endless sheet metal strip having a thickness between 0.03 mm and 0.2 mm. The heat exchanger tube has two narrow sides and two wide sides. First and second folds are arranged in the sheet metal strip. A narrow side is formed by means of bends arranged in the narrow side.

DE 10 2014 200 708 A1 concerns a flat tube for a heat exchanger, wherein the flat tube is produced by folding in two mutually opposite free end regions of a one-piece band material. The flat tube has two wide sides and two narrow sides which are formed by an outer structure of the flat tube. An inner structure which subdivides the interior of the flat tube into a plurality of ducts is arranged in the interior of the flat tube.

SUMMARY

It is an object of the present invention to demonstrate new approaches in the development of tube bodies, in particular for use in heat exchangers.

This object is achieved by the subject matter of the independent patent claim(s). Preferred embodiments form the subject matter of the dependent patent claim(s).

Accordingly, the basic idea of the invention is for a tube body with an outer structure for delimiting a fluid line and an inner structure for subdividing the fluid line into a plurality of individual fluid ducts to be produced in one piece from a band strip. In this context, according to the invention, a material thickness of the band material forming the inner structure is less, at least in certain portions, than a material thickness of the band material forming the outer structure. Since the inner structure serves not only for producing individual fluid ducts but at the same time has the effect of reinforcing the outer structure and thus the entire tube body, there is as a result created a tube body which has a reduced inherent weight in comparison to conventional tube bodies without losses in the stiffness of the tube body being entailed thereby.

A tube body according to the invention, in particular for a heat exchanger, comprises an outer structure composed of a band material, which outer structure delimits an outer structure interior space. For this purpose, the tube body has two mutually opposite wide sides and two mutually opposite narrow sides. Integrally formed on the outer structure—and thus likewise composed of the band material—is an inner structure which is arranged in the outer structure interior space. The inner structure subdivides the outer structure interior space into at least two fluid ducts which are fluidically separated from one another and intended for the through-flow of a fluid. According to the invention, a material thickness of the band material of the inner structure is less, at least in certain portions, than a material thickness of the band material of the outer structure.

In a preferred embodiment, the tube body is formed in one piece. This allows simple production of the tube body from a band material, in particular from one or more sheet metal strips.

In a further preferred embodiment, the outer structure has a main portion which transitions at the ends into two secondary portions. The two secondary portions are folded in towards the centre to form a closed tube body profile, with the result that the main portion forms a first wide side and the two secondary portions form a second wide side. In this way, it can be ensured, even when using a band material having a small material thickness, that the outer contour has a high degree of stiffness.

In a further preferred embodiment, in order to form the at least two fluid ducts, the inner structure has a region of corrugated form. Said corrugated region is supported on the mutually opposite wide sides of the outer structure. The formation of a corrugated region allows the subdivision according to the invention of the outer structure interior space into at least two fluid ducts by means of the inner structure in a technically simple manner.

The corrugated region is particularly preferably formed without kinks. In this way, a particularly high degree of stiffness can be ensured in the inner structure.

Preferably, the corrugated region has a wave-like geometry. In this way, mechanical stiffness of the inner structure can be significantly enhanced.

In an advantageous development, the corrugated region having a wave-like geometry is supported on the mutually opposite wide sides of the outer structure by means of supporting areas located at apex zones of the corrugate region. In this way, mechanical stiffness of the inner structure can be significantly enhanced.

In a further preferred embodiment, the material thickness of the band material has a constant value in the corrugated region of the inner structure. This measure is accompanied by a significant reduction in production costs.

The two secondary portions particularly expediently in each case have an outer structure end portion in which the outer structure respectively transitions into the inner structure. In this variant, the material thickness of the band material decreases at the transition from the outer structure into the respective inner structure. In this way, the inherent weight of the entire tube body can be kept particularly low.

In another preferred embodiment, a recess is formed in at least an outer structure end portion, preferably in both outer structure end portions. In this way, folding of the inner structure can be significantly facilitated.

In another advantageous embodiment, the recess is located in an inner side of the outer structure end portion facing the inner structure.

In another preferred embodiment, the inner structure has two inner structure end portions which face away from the outer structure. In this variant, the material thickness of the band material in the inner structure end portions is enlarged in comparison to the corrugated region of the inner structure. This measure allows particularly stable fastening of the inner structure to the outer structure with the aid of said inner structure end portions.

Particularly stable fastening of the inner structure to the outer structure can be achieved in a further preferred embodiment in which at least one inner structure end portion fits snugly against a narrow side of the outer structure. This particularly preferably applies to both inner structure end portions of the inner structure.

The at least one inner structure end portion and the narrow side assigned to this inner structure end portion preferably have a round contour, particularly preferably the contour of a segment of a circle. Such a contour can be produced particularly simply by means of a folding operation.

The tube body expediently has in the tube profile an axis of symmetry which extends along an axis direction defined by the narrow sides. In this variant, the tube body is formed axisymetrically with respect to this axis of symmetry. A tube body formed symmetrically in such a way can be produced in a particularly simple manner. This leads to reduced costs in the production of the tube body.

The tube body is particularly expediently formed as a profiled part whose tube profile extends along a direction of longitudinal extent which runs orthogonally to the wide sides and to the narrow sides. In this way, it is also possible for tube bodies having a considerable tube length along the direction of longitudinal extent to be produced with a high degree of stiffness.

The band material can expediently be a sheet metal strip. This allows simple production of the tube body using suitable machines for sheet metal processing.

The invention further relates to a heat exchanger having at least one tube body as presented above.

The invention also relates to a method for producing a tube body as presented above from a band material, in particular from a sheet metal strip. In the method according to the invention, a material thickness in the region of an inner structure of the tube body that is to be formed is reduced, at least in certain portions, in comparison to an outer structure of the tube body that is to be formed.

In an advantageous development, the reduction in the material thickness is obtained by means of a rolling process.

Further important features and advantages of the invention will become apparent from the subclaims, from the drawing and from the associated description of the FIGURE with reference to the drawing.

It will be understood that the features mentioned above and those yet to be explained below can be used not only in the combination specified in each case, but also in other combinations or alone, without departing from the scope of the present invention.

Preferred exemplary embodiments of the invention are illustrated in the drawing and are explained in more detail in the description which follows.

BRIEF DESCRIPTION OF THE DRAWINGS

In each case schematically,

FIG. 1 shows a profile view of a one piece tube body according to the invention.

DETAILED DESCRIPTION

The single FIG. 1 shows by way of example a tube body 1 according to the invention which is formed in one piece, in profile. The tube body 1 can be used as a fluid line in a heat exchanger. The tube body 1 comprises an outer structure 2 composed of a band material 10, which outer structure delimits an outer structure interior space 4. The outer structure 2 has a first wide side 5*a* and a second wide side 5*b* opposite the first wide side 5*a*. Furthermore, the outer structure has a first narrow side 6*a* and a second narrow side 6*b* opposite the first narrow side 6*a*. Furthermore, the tube body 1 comprises an inner structure 3 integrally formed on the outer structure 2 and composed of the band material. The inner structure 3 is arranged in the outer structure interior space 4 and subdivides it into a plurality of fluid ducts 7 which are fluidically separated from one another and are intended for the through-flow of a fluid. The band material 10 can be a sheet metal strip or can comprise at least one sheet metal strip.

The tube profile 1 is formed as a profiled part whose tube profile extends along a direction of longitudinal extent L which runs orthogonally to the wide sides 5*a*, 5*b* and to the narrow sides 6*a*, 6*b*.

The outer structure 2 has in profile a main portion 8 which transitions at its two ends into two secondary portions 9*a*, 9*b*. The two secondary portions 9*a*, 9*b* are folded in towards the centre 11 to form a closed tube body profile. As can be seen from FIG. 1, the main portion 8 forms the first wide side 5*a* of the outer structure 2, whereas the two secondary portions 9*a*, 9*b* form the second wide side 5*b*.

The inner structure 3 is of corrugated form in certain portions. For this purpose, the inner structure 3 has a region 12 of corrugated form in profile. In the region 12, the inner structure 3 is supported on the two mutually opposite wide sides 5*a*, 5*b* of the outer structure 2. As shown in FIG. 1, the corrugated region 12 is preferably formed without kinks in profile. Moreover, the corrugated region 12 can have a wave-like geometry. In this way, mechanical stiffness of the inner structure 3 can be significantly enhanced. The corrugated region 12 having a wave-like geometry is supported on the mutually opposite wide sides 5*a*, 5*b* of the outer structure 2 by means of supporting areas 17 located at apex zones 18 of the corrugate region. In this way, mechanical stiffness of the inner structure 3 can be enhanced.

As can be seen from FIG. 1, a material thickness $d_I$ of the band material 10 of the corrugated region 12 is less than a material thickness $d_A$ of the band material 10 of the outer structure 2. Preferably, the material thickness $d_I$ of the band material has a constant value in the corrugated region 12 of the inner structure 3. This measure is accompanied by a significant reduction in production costs.

According to FIG. 1, the two secondary portions 9*a*, 9*b* in each case have an outer structure end portion 13*a*, 13*b* in which the outer structure 2 respectively transitions into the inner structure 3 in the profile shown in FIG. 1. The material thickness of the band material decreases at the transition from the outer structure into the respective inner structure from the value $d_A$ to the value $d_I$.

In the profile of the tube body 1 that is shown in FIG. 1, the inner structure 3 has two inner structure end portions 14*a*, 14*b* which face away from the outer structure 2. The first inner structure end portion 14*a* fits snugly on the inside against the first narrow side 6*a* of the outer structure 2. The second inner structure end portion 14*b* fits snugly on the inside against the second narrow side 6*b* of the outer structure 2.

In the inner structure end portions 14*a*, 14*b* of the inner structure 3, the material thickness of the band material 10 is enlarged in comparison to the corrugated region 12 of the inner structure 3. In particular, the material thickness of the inner structure end portions 14*a*, 14*b* can have the same value as the material thickness $d_A$ of the outer structure 2.

The two inner structure end portions 14*a*, 14*b* and the two narrow sides 6*a*, 6*b* can in each case have a round contour, preferably the contour of a segment of a circle as illustrated in FIG. 1.

According to FIG. 1, the tube body 1 has in the profile of FIG. 1 an axis of symmetry S which extends along an axis direction A defined by the narrow side. As can be seen from FIG. 1, the tube body 1 is formed axisymetrically with respect to this axis of symmetry S.

During the production of the tube body 1 described here, the inner structure 3 can be formed from the band material 10, that is to say typically from a sheet metal strip, by reducing the material thickness of the band material 10. By contrast, there is no need for such a reduction in the material thickness in that region of the band material 10 which is to form the outer structure 2. The desired reduction in the material thickness can preferably be achieved with the aid of a rolling process. Preferably, the reduced material thickness has an value of at least 0.01 mm.

According to FIG. 1, a recess 15*a*, 15*b* can be formed in the outer structure end portions 9*a*, 9*b*, respectively. In this way, when fabricating the tube body 1, folding of the inner structure 3 with respect to the outer structure 2, can be significantly facilitated. Preferably, the recess is located in an inner side 16*a*, 16*b* of the respective outer structure end portion 9*a*, 9*b* facing the inner structure 3.

The invention claimed is:

1. A tube body for a heat exchanger, comprising:

an outer structure composed of a band material, the outer structure including two mutually opposite wide sides and two mutually opposite narrow sides delimiting an outer structure interior space; and an inner structure integrally arranged on the outer structure and composed of the band material, the inner structure arranged in the outer structure interior space and dividing the outer structure interior space into at least two fluid ducts fluidically separated from one another through which a fluid is flowable;

wherein, at least in certain portions of the inner structure, a material thickness of the band material of the inner structure is less than a material thickness of the band material of the outer structure;

wherein the inner structure includes a corrugated region disposed within the outer structure interior space and extending therein such that the corrugated region contacts the two wide sides of the outer structure in an alternating manner providing a support therebetween;

wherein the corrugated region is structured without kinks;

wherein the corrugated region has a wavy geometry including a plurality of oscillating rounded peaks each having an apex;

wherein the inner structure has two inner structure end portions each disposed adjacent to an associated one of the two narrow sides of the outer structure;

wherein a material thickness of the band material of the two inner structure end portions is greater than a material thickness of the band material of the corrugated region; and wherein the corrugated region has two longitudinal ends that each transition into a respective inner structure end portion of the two inner structure end portions beginning at an associated apex of the apexes.

2. The tube body according to claim 1, wherein the tube body is structured as a single piece.

3. The tube body according to claim 1, wherein the outer structure has a main portion having two ends transitioning into two secondary portions, and wherein the two secondary portions fold in towards a centre to form a closed tube body profile such that the main portion defines a first wide side of the two wide sides of the outer structure and the two secondary portions together define a second wide side of the two wide sides of the outer structure.

4. The tube body according to claim 1, wherein:

the inner structure and the outer structure are provided as a single piece; and two opposite ends of the outer structure abut one another and fold in towards a centre, the two opposite ends of the outer structure transitioning into the inner structure within the outer structure interior space.

5. The tube body according to claim 1, wherein the corrugated region is supported on the two wide sides of the outer structure via supporting areas disposed at apex zones of the plurality of oscillating rounded peaks of the corrugated region.

6. The tube body according to claim 1, wherein the material thickness of the band material of the corrugated region is constant along an entire length of the corrugated region.

7. The tube body according to claim 3, wherein the two secondary portions each have an outer structure end portion where the outer structure transitions into the inner structure, and wherein a material thickness of the band material decreases at a transition from the outer structure into the inner structure.

8. The tube body according to claim 7, wherein the outer structure end portion of at least one of the two secondary portions includes a recess.

9. The tube body according to claim 8, wherein the recess is disposed in an inner side of one of the outer structure end portions which faces the outer structure interior space, and wherein the transition from the outer structure to the inner structure begins within the recess.

10. The tube body according to claim 1, wherein at least one inner structure end portion of the two inner structure end portions abuts against and extends along one of the two narrow sides of the outer structure.

11. The tube body according to claim 1, wherein at least one inner structure end portion of the two inner structure end portions and an associated narrow side of the two narrow sides of the outer structure have a round contour.

12. The tube body according to claim 1, further comprising a tube profile having an axis of symmetry extending along an axis direction defined by the two narrow sides of the outer structure, wherein the tube body is structured symmetrically with respect to the axis of symmetry.

13. The tube body according to claim 1, wherein the tube body is structured as a profiled part having a tube profile extending along a direction of longitudinal extent extending orthogonally to the two wide sides of the outer structure and orthogonally to the two narrow sides of the outer structure.

14. The tube body according to claim 1, wherein the band material is a sheet metal strip.

15. A heat exchanger comprising at least one tube body including:

a band material defining an outer structure and an inner structure;

the outer structure including two mutually opposite wide sides and two mutually opposite narrow sides delimiting an outer structure interior space;

the inner structure integrally disposed on the outer structure and arranged within the outer structure interior space such that the outer structure interior space is divided into at least two fluidically separated fluid ducts through which a fluid is flowable;

wherein, at least in certain portions of the inner structure, a band material thickness of the inner structure is smaller than a band material thickness of the outer structure;

wherein the inner structure includes a corrugated region and has two inner structure end portions disposed at opposite ends of the corrugated region, the two inner structure end portions each contacting and extending along an associated one of the two narrow sides of the outer structure;

wherein the corrugated region has a wavy geometry including a plurality of oscillating rounded peaks each having an apex;

wherein the corrugated region has two longitudinal ends that each transition into a respective inner structure end portion of the two inner structure end portions at an associated apex of the apexes; and wherein the corrugated region has a continuous band material thickness, and a band material thickness of the two inner structure end portions is greater than the continuous band material thickness of the corrugated region.

16. The tube body according to claim 8, wherein the material thickness of the band material of the outer structure gradually decreases from a bottom of the recess to the material thickness of the band material of the inner structure.

* * * * *